United States Patent [19]

Resta et al.

[11] Patent Number: 4,809,899

[45] Date of Patent: Mar. 7, 1989

[54] AUTOMATIC APPARATUS FOR THE STAPLING OF COVERING CLOTHS TO MATTRESS SPRINGS

[75] Inventors: Rodolfo Resta; Mario Resta; Roberto Resta, all of Faenza, Italy

[73] Assignee: Resta Commerciale S.r.l., Faenza Ra, Italy

[21] Appl. No.: 96,191

[22] Filed: Sep. 14, 1987

[30] Foreign Application Priority Data

Sep. 26, 1986 [IT] Italy ..... 3523 A/86

[51] Int. Cl.[4] ..... B27F 7/17

[52] U.S. Cl. ..... 227/25; 227/65; 227/111

[58] Field of Search ..... 227/20, 111, 65, 25; 29/432,509; 112/121.14

[56] References Cited

U.S. PATENT DOCUMENTS 2,062,359 12/1936 Gail ..... 112/121.14
2,360,115 10/1944 Droll ..... 227/20
3,084,345 4/1963 Hodges, Jr. ..... 227/20

*Primary Examiner*—Frank T. Yost
*Assistant Examiner*—James L. Wolfe
*Attorney, Agent, or Firm*—Guido Modiano; Albert Josif

[57] ABSTRACT

The automatic apparatus for the stapling of covering cloths to mattress springs comprises a base plane, jack-like members for comprising the mattress springs between two apposed covering cloths on said base plane, a carriage slideable laterally to respective sides of the base plane and provided with devices for folding the borders of said cloths on the end coils of the outermost springs, devices for stapling the folded borders of the covering clothes and carried by the slidable carriages and finally motorized equipments for reciprocating the slideable carriages.

6 Claims, 2 Drawing Sheets

AUTOMATIC APPARATUS FOR THE STAPLING OF COVERING CLOTHS TO MATTRESS SPRINGS

BACKGROUND OF THE INVENTION

The present invention relates to an apparatus for the stapling of covering cloths to mattress springs.

As is known, the springing of mattresses is generally achieved by means of a plurality of helical cylindrical springs arranged in an orderly way between two covering cloths and coupled to one another. The borders of said cloths are usually folded over the end coils of the springs and are fixed with a series of staples.

Currently, the above described operation is performed manually by means of an ordinary stapling machine. It is therefore obvious that this entails considerable manual labor, since it is necessary to operate on both cloths and along all the sides thereof. Possible defects in the execution of the stapling are furthermore observed.

SUMMARY OF THE INVENTION

The aim of the present invention is to solve the abovementioned problem by devising an apparatus capable of performing automatically the stapling of the springs to the covering cloths.

Within the scope of this aim, a further object of the invention is to provide an apparatus which is simple in concept, is safely reliable in operation and versatile in use according to the different dimensions of the mattresses.

This aim and this object are both achieved, according to the invention, by an automatic apparatus for the stapling of covering cloths to mattress springs characterized in that it comprises a base plane, means for compressing said springs between said covering cloths on said base plane, slider means slideable laterally to respective sides of said base plane and provided with means for folding the borders of said cloths on the end coils of the outer springs, means for the stapling of said folded borders carried by said slider means, and finally means for the alternating operation of said slider means.

BRIEF DESCRIPTION OF THE DRAWINGS

The details of the invention will become apparent from the detailed description of a preferred embodiment of the apparatus for the stapling of mattress springs, illustrated only by way of non-limitative example in the accompanying drawings, wherein.

DESCRIPTION OF THE PREFERRED EMBODIMENTS

Figures 1, 2, 5:
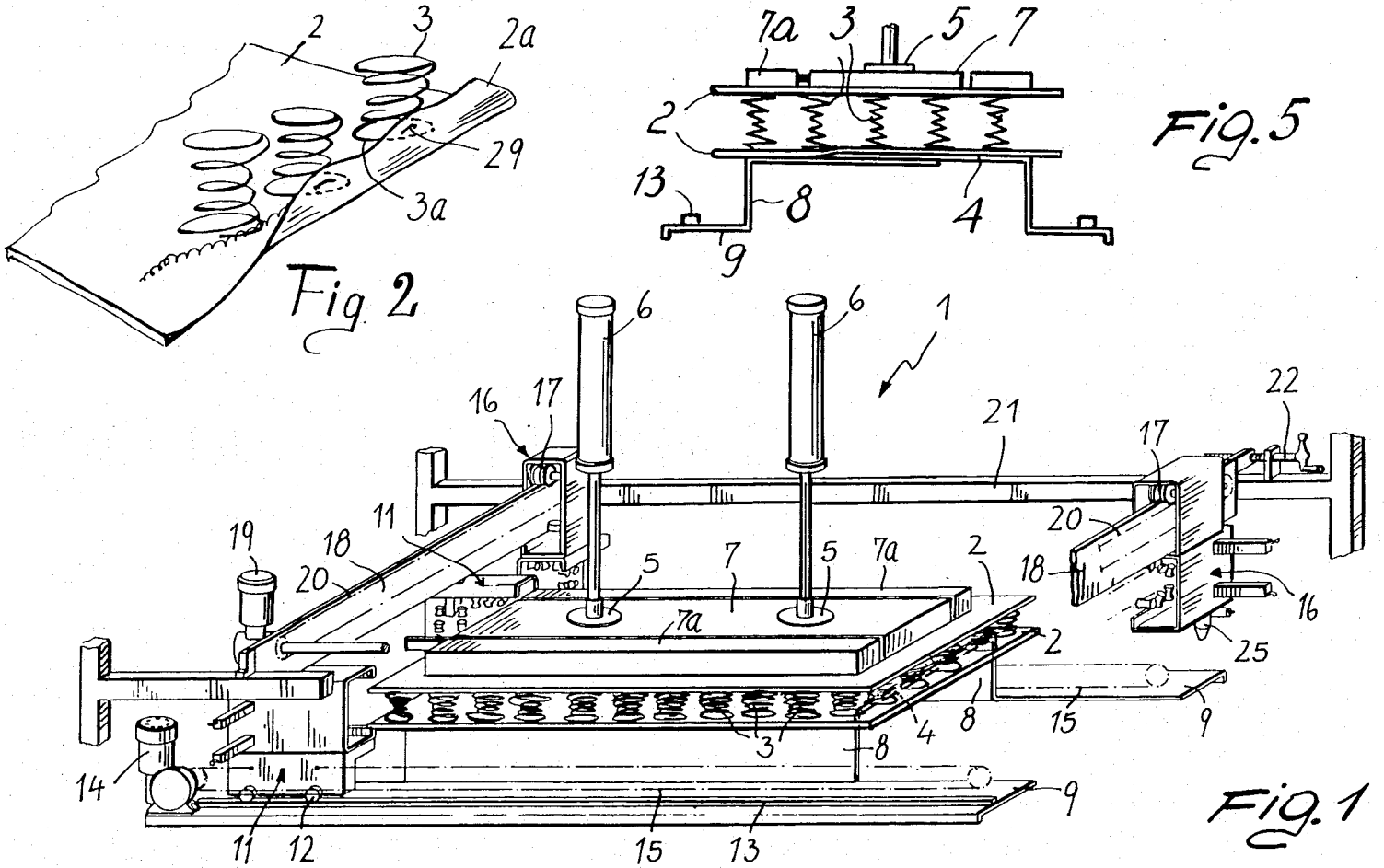
FIG. 1 is a partially schematic perspective view of the apparatus according to the invention.
FIG. 2 is a perspective detail view of the cloth's region of folding on the springs.
FIG. 5 is a transverse view of the mattress base plane.

With reference to the above described figures, the reference numeral 1 generally indicates the apparatus which automatically performs the stapling of the covering cloths 2 perimetrally with respect to a cage of helical springs 3, adapted to constitute the springing of a mattress and distributed on a rectangular surface.

The apparatus 1 comprises a base plane 4 whereon the spring case 3 and the related cloths 2 are secured by a pair of presser elements 5 operated by related vertical jacks 6 and acting on a plate 7 adapted to distribute the pressure uniformly. Conveniently, the base plane 4 and the plate 7 have transverse dimensions which are adjustable according to those of the mattress to be manufactured. For this purpose, the base plane 4 is in fact composed of a pair of panels superimposed and slideable with respect to one another, from which related sides 8 extend downwards; similarly, the plate 7 is provided with a pair of panels respectively rigidly associated with lateral portions *7a* of said plate.

The sides 8 of the base plane 4 are folded outwards to form respective brackets 9, arranged longitudinally with respect to the cage of springs 3 and related cloths 2. A pair of sliders 11 are supported on the brackets 9 and are slideable by means of rollers 12 on related rails 13. The sliders 11 are controlled synchronously with an alternating motion by a motor element 14 which operates related chains 15, rotatably carried along the brackets 9. A further pair of sliders 16 is slideably supported by means of rollers 17 on bars or rails 18, respectively arranged laterally to the transverse sides of the cage of springs 3 and of the related cloths 2.

The sliders 16 are controlled synchronously with an alternating movement by a further motor element 19 which operates related chains 20, rotatably carried on the bars 18.

The bars 18 are mounted on a fixed frame 21 of the apparatus.

Advantageously, at least one of said bars is movable by means of a conventional screw element 22, so as to adjust their mutual distance according to the longitudinal dimensions of the mattress.

Figure 4:
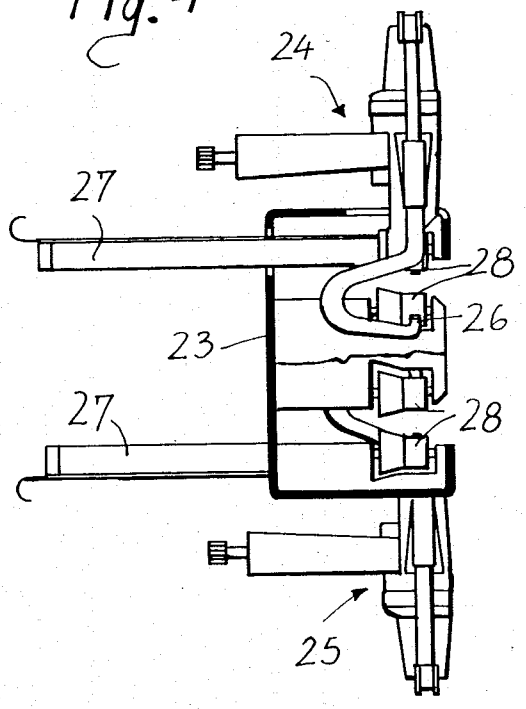
FIG. 4 is a cross section view along the line IV—IV of FIG. 3.
Figure 3:
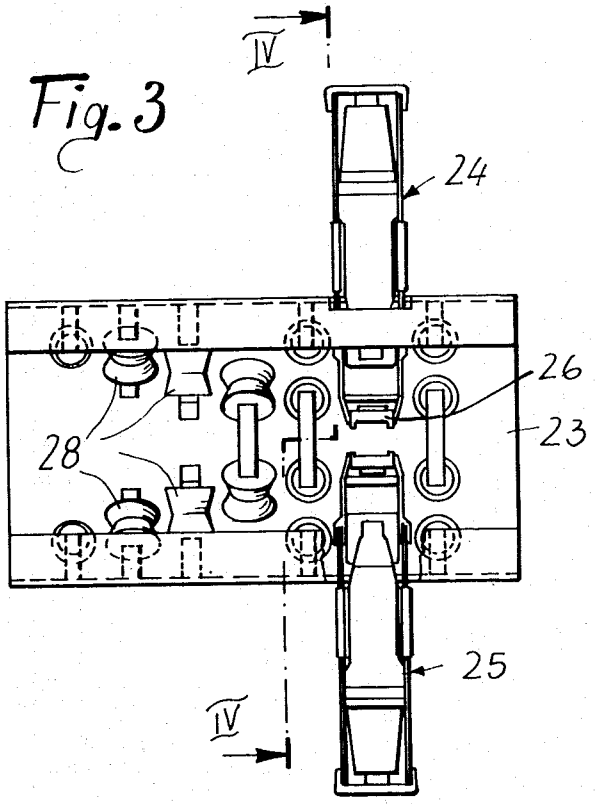
FIG. 3 is a front view of the stapling devices.

The sliders 11 and 16 are constituted in a similar manner (as illustrated in detail in FIGS. 3 and 4) by a C-shaped box 23 adapted to support a pair of staplers 24, 25 arranged vertically counterposed. The staplers 24, 25, of a substantially known type, are provided, towards the interior of the box 23, with a related stapling abutment 26; furthermore, respective magazines 27 for containing the staplers project outwards from the box 23.

Inside the box 23, a double set of folding rollers 28 is rotatably mounted, the borders of the cloths 2 being caught and progressively folded therebetween. The axes of said rollers 28 are in fact successively inclined with respect to one another, until they are rotated through 180° at the stapling region.

Therefore, the borders of both covering cloths are taken up between the rollers 28 of the sliders 11 and 16, which move actuated by the motors 14 and 16, and are folded inwards. As illustrated in detail in FIG. 2, the folded border *2a* partially covers the end coil *3a* of the outer springs of the cage.

Simultaneously, the staplers 24, 25 are operated and fix the folded border *2a* at each ring *3a* with staples 29.

To summarize, the apparatus described allows to perform automatically, in a rapid and precise manner, the simultaneous stapling of the different sides of both spring covering cloths.

In the practical embodiment of the invention, the materials employed, the shape and the dimensions may be any according to the requirements.

We claim:

1. An automatic apparatus for stapling covering cloths to mattress springs in a mattress structure, said mattress structure comprising an upper and a lower spaced-apart covering cloths with a plurality of mattress springs arranged therebetween, said covering cloths defining longitudinal and transverse borders thereof, the mattress springs to be stapled being located peripherally of said cloths and adjacent said longitudinal and transverse borders thereof, said apparatus comprising a substantially horizontal base plate for supporting said mattress structure; means for uniformly compressing said mattress structure on said base plate; slidable carriage means arranged peripherally of said base plate which carry means for folding said respective cloth borders and means for stapling the thus folded cloth borders to said peripheral mattress springs; and motor means for syncronously and reciprocally-operating said slidable carriage means.

2. Apparatus according to claim 1, wherein said stapling means comprises a pair of stapling devices mounted on each carriage means in a vertically spaced-apart relationship for the simultaneous stapling of said upper and said lower cloths to said peripheral mattress springs.

3. An automatic apparatus according to claim 1, wherein two pairs of rails are arranged on opposite longitudinal and transverse sides of said base plate for slidingly supporting said carriage means, each rail being associated with said motor means, a motorized endless chain being comprised by said motor means and being connected to said carriage means for reciprocating and syncronous movement thereof lengthwise of said rails.

4. An automatic apparatus according to claim 1, wherein said folding means comprises a plurality of rollers located longitudinally of said carriage means and having progressively inclined axes so as to take up and fold over a respective cloth border.

5. An automatic apparatus according to claim 1, wherein said base plate further comprises a pair of substantially coplanar side panels which are mutually slidable to permit adjustment of the actual transverse size of said base plate, said side panels rigidly mounting said longitudinal and said transverse rails.

6. An automatic apparatus according to claim 1, wherein said compressing means comprise a pressure plate superposed to said upper covering cloth and having transverse adjustable dimensions and at least one power actuated pressure element acting on said pressure plate.

* * * * *